US011939036B2

(12) United States Patent
Perdomo Tornbaum et al.

(10) Patent No.: US 11,939,036 B2
(45) Date of Patent: Mar. 26, 2024

(54) DEVICES AND METHODS FOR COUPLING PROPULSION DEVICES TO MARINE VESSELS

(71) Applicant: Brunswick Corporation, Mettawa, IL (US)

(72) Inventors: Andres Perdomo Tornbaum, Neenah, WI (US); Wayne M. Jaszewski, Jackson, WI (US); Robert A. Podell, Slinger, WI (US); Jeremy J. Kraus, Mt.Calvary, WI (US); James E. Erickson, Fon du Lac, WI (US); Randall J. Poirier, Fond du Lac, WI (US); Derek J. Fletcher, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 330 days.

(21) Appl. No.: 17/377,061

(22) Filed: Jul. 15, 2021

(65) Prior Publication Data

US 2023/0020248 A1 Jan. 19, 2023

(51) Int. Cl.

| | |
|---|---|
| ***B63H 20/08*** | (2006.01) |
| ***B63H 21/30*** | (2006.01) |
| *B63B 35/34* | (2006.01) |

(52) U.S. Cl.

CPC ..... *B63H 21/30* (2013.01); *B63B 35/34* (2013.01)

(58) Field of Classification Search

CPC ..... B63H 21/30; B63H 2025/425; B63H 20/007; B63B 35/34; B63B 1/125

See application file for complete search history.

(56) References Cited

U.S. PATENT DOCUMENTS

| | | | |
|---|---|---|---|
| 2,213,520 | A | 9/1940 | Gentry |
| 3,236,202 | A | 2/1966 | Quady et al. |
| 3,462,102 | A | 8/1969 | Rivers |

(Continued)

FOREIGN PATENT DOCUMENTS

| | | |
|---|---|---|
| EP | 1611007 | 8/2007 |
| EP | 1914161 | 4/2008 |

(Continued)

OTHER PUBLICATIONS

International Search Report and Written Opinion for International Application No. PCT/CA/2016/050308 dated Jun. 9, 2016.

(Continued)

*Primary Examiner* — Amy J. Sterling

(74) *Attorney, Agent, or Firm* — Andrus Intellectual Property Law, LLP

(57) ABSTRACT

A device for coupling a propulsor to a marine vessel. A rail is configured for attachment to the marine vessel. A carriage is moveable relative to the rail into first and second positions. A shaft has a first end pivotally coupled to the marine vessel and a second end for coupling to the propulsor. An actuator is configured to pivot the shaft relative to the marine vessel to thereby move the propulsor into and between stowed and deployed positions. A lock is manually operable to fix the carriage in the first position in which the actuator prevents manual pivoting of the shaft and alternatively in the second position in which the shaft is permitted to be manually pivoted.

20 Claims, 15 Drawing Sheets

(56) References Cited

U.S. PATENT DOCUMENTS

| | | | |
|---|---|---|---|
| 3,809,343 | A | 5/1974 | Adams et al. |
| 3,865,335 | A | 2/1975 | Roller et al. |
| 3,874,318 | A | 4/1975 | Langley |
| 3,995,579 | A | 12/1976 | Childre |
| 3,999,500 | A | 12/1976 | Friedel et al. |
| 4,008,680 | A | 2/1977 | Alexander, Jr. |
| 4,294,186 | A | 10/1981 | Wardell |
| 4,410,161 | A | 10/1983 | Booty |
| 4,548,586 | A | 10/1985 | Philips |
| 4,734,068 | A | 3/1988 | Edwards |
| 4,875,656 | A | 10/1989 | Boede |
| 4,911,398 | A | 3/1990 | DiIulio et al. |
| 4,966,566 | A | 10/1990 | Baird |
| 4,968,275 | A | 11/1990 | Carlson |
| 5,005,798 | A | 4/1991 | McCoy |
| 5,022,609 | A | 6/1991 | Cranston |
| 5,131,875 | A | 7/1992 | Lee |
| 5,152,240 | A | 10/1992 | Fontanille |
| 5,195,914 | A | 3/1993 | Binversie et al. |
| 5,277,630 | A | 1/1994 | Clark |
| 5,499,792 | A | 3/1996 | Tamiso |
| 5,595,133 | A | 1/1997 | Bullard |
| 5,639,272 | A | 6/1997 | Henderson et al. |
| 5,669,794 | A | 9/1997 | Knight et al. |
| 5,941,742 | A | 8/1999 | Whitaker |
| 6,142,841 | A | 11/2000 | Alexander, Jr. et al. |
| D439,723 | S | 3/2001 | Avery |
| 6,257,165 | B1 | 7/2001 | Danos et al. |
| 6,280,267 | B1 | 8/2001 | Griffith, Sr. et al. |
| 6,325,685 | B1 | 12/2001 | Knight et al. |
| 6,431,923 | B1 | 8/2002 | Knight et al. |
| 6,592,412 | B1 | 7/2003 | Geil et al. |
| 6,789,648 | B2 | 9/2004 | Cook |
| 7,004,803 | B2 | 2/2006 | Ruffe |
| 7,004,804 | B2 | 2/2006 | Bernloehr et al. |
| RE39,032 | E | 3/2006 | Gonring et al. |
| D524,225 | S | 7/2006 | Tsutsumi |
| 7,150,662 | B1 | 12/2006 | Janitz |
| 7,182,033 | B1 | 2/2007 | Philips et al. |
| 7,185,599 | B1 | 3/2007 | Griffiths et al. |
| 7,285,029 | B1 | 10/2007 | Janitz |
| 7,294,029 | B1 | 11/2007 | Spaulding |
| 7,305,928 | B2 | 12/2007 | Bradley et al. |
| 7,399,211 | B1 | 7/2008 | Spaulding |
| 7,510,450 | B1 | 3/2009 | Dresher |
| 7,520,239 | B2 | 4/2009 | Bryham |
| 7,533,622 | B1 | 5/2009 | Jaszewski et al. |
| 7,753,745 | B2 | 7/2010 | Schey et al. |
| 7,806,065 | B1 | 10/2010 | Bekker et al. |
| 7,887,381 | B2 | 2/2011 | Brass et al. |
| 7,946,243 | B1 | 5/2011 | Ulrich |
| 8,011,982 | B1 | 9/2011 | Baier et al. |
| 8,051,793 | B2 | 11/2011 | Ulgen |
| 8,123,577 | B2 | 2/2012 | Riggs |
| 8,479,677 | B2 | 7/2013 | Bolline et al. |
| 8,814,616 | B2 | 8/2014 | Riggs |
| 9,108,710 | B1 | 8/2015 | McChesney et al. |
| 9,296,455 | B2 | 3/2016 | Bernloehr et al. |
| 9,586,655 | B1 | 3/2017 | Butler |
| 9,738,364 | B2 | 8/2017 | Abney |
| 9,889,914 | B1 | 2/2018 | Ostrowsky |
| 9,896,162 | B2 | 2/2018 | McClure |
| 9,969,474 | B1 | 5/2018 | Traux et al. |
| D834,617 | S | 11/2018 | Zin et al. |
| 10,167,069 | B2 | 1/2019 | Houle et al. |
| 10,220,926 | B1 | 3/2019 | Pelini |
| D852,230 | S | 6/2019 | Zin et al. |
| D852,848 | S | 7/2019 | Zin et al. |
| D852,849 | S | 7/2019 | Zin et al. |
| D852,850 | S | 7/2019 | Zin et al. |
| 10,407,131 | B1 | 9/2019 | Ward |
| 10,718,142 | B1 | 7/2020 | Amerling et al. |
| 10,850,820 | B1 * | 12/2020 | Minogue ..... B63H 20/06 |
| 11,312,462 | B1 | 4/2022 | Faust et al. |
| 11,591,057 | B2 | 2/2023 | Tornbaum et al. |
| 11,603,179 | B2 * | 3/2023 | Poirier ..... B63H 20/10 |
| D983,838 | S | 4/2023 | Zin et al. |
| D984,952 | S | 5/2023 | Qiao |
| 11,643,176 | B1 | 5/2023 | Mueller et al. |
| 2002/0142680 | A1 * | 10/2002 | Anderson ..... B63H 20/007 440/53 |
| 2005/0159053 | A1 | 7/2005 | Ruffe |
| 2006/0228959 | A1 | 10/2006 | Ruiz |
| 2007/0232159 | A1 * | 10/2007 | Lee ..... B63H 20/007 440/63 |
| 2008/0190227 | A1 | 8/2008 | Myers et al. |
| 2009/0227158 | A1 | 9/2009 | Bernloehr et al. |
| 2010/0032545 | A1 | 2/2010 | Bernloehr et al. |
| 2010/0116967 | A1 | 5/2010 | Todd et al. |
| 2010/0136857 | A1 | 6/2010 | Goudsmit |
| 2012/0097086 | A1 | 4/2012 | Sancoff |
| 2014/0158037 | A1 | 6/2014 | George |
| 2015/0201548 | A1 | 7/2015 | Wolter et al. |
| 2015/0259033 | A1 | 9/2015 | George et al. |
| 2015/0298782 | A1 * | 10/2015 | Bernloehr ..... B63H 20/007 440/6 |
| 2016/0001865 | A1 * | 1/2016 | Bernloehr ..... B63H 21/17 440/7 |
| 2017/0203823 | A1 | 7/2017 | Abney |
| 2017/0341718 | A1 | 11/2017 | Zimmerman |
| 2018/0057130 | A1 | 3/2018 | Houle et al. |
| 2018/0334233 | A1 | 11/2018 | Vance |
| 2019/0217921 | A1 | 7/2019 | Shibayama et al. |
| 2021/0354803 | A1 | 11/2021 | Christensen et al. |
| 2021/0380210 | A1 | 12/2021 | Fishburn et al. |
| 2022/0266968 | A1 | 8/2022 | Tornbaum et al. |

FOREIGN PATENT DOCUMENTS

| | | |
|---|---|---|
| EP | 2757037 | 7/2014 |
| EP | 2242678 | 11/2015 |
| EP | 2246252 | 5/2019 |
| GB | 2554045 | 3/2018 |
| JP | 2013100013 | 5/2013 |

OTHER PUBLICATIONS

"Oceansouth Outboard Motor Cowling Cover for Yamaha F25G 432cc 2CYL (2017-2023)" Amazon.com, post Published Jun. 25, 2019. Retrieved Jul. 10, 2023. Available online at URL:https://www.amazon.com/Oceansouth-Outboard-Motor-Cover-Yamaha/dp/B07TJ1JMYD(Year:2019).

"Evinrude Boat Engine Side Panel 0286108 Silver Starboard Cowling" greatlakeskipper.com, post Published: Unavailable. Retrieved Jul. 10, 2023. Available online at URL:https://www.greatlakeskipper.com/evinrude-boat-engine-side-panel-0286108-silver-starboard-cowling(Year: 2023).

Tornbaum, Andres Perdomo, "Methods for a Marine Vessel with Primary and Auxiliary Propulsion Devices," Unpublished U.S. Appl. No. 16/984,617, filed Aug. 4, 2020 (specification and drawings only).

Owerboat Television, "How to make docking a pontoon boat easy with a retractable SideShift Thruster | My Boat DIY", YouTube video, Jun. 1, 2020, available at https://www.youtube.com/watch?v=2NBx-Vnl3Kk.

Sideshift Inc., "Sideshift Dock Like a Pro PT230/PT360 Pontoon Thruster System," Installation/Operation Manual, Oct. 2019, vol. 2.4.

* cited by examiner

DEVICES AND METHODS FOR COUPLING PROPULSION DEVICES TO MARINE VESSELS

FIELD

The present disclosure generally relates to propulsors for marine vessels.

BACKGROUND

The following U.S. Patents provide background information and are incorporated by reference in entirety.

U.S. Pat. No. 6,142,841 discloses a maneuvering control system which utilizes pressurized liquid at three or more positions of a marine vessel to selectively create thrust that moves the marine vessel into desired locations and according to chosen movements. A source of pressurized liquid, such as a pump or a jet pump propulsion device, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired.

U.S. Pat. No. 7,150,662 discloses a docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

U.S. Pat. No. 7,305,928 discloses a vessel positioning system which maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,753,745 discloses status indicators for use with a watercraft propulsion device. An example indicator includes a light operatively coupled to a propulsion device of a watercraft, wherein an operation of the light indicates a status of a thruster system of the propulsion device.

U.S. Pat. No. RE39032 discloses a multipurpose control mechanism which allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

European Patent Application No. EP 1,914,161, European Patent Application No. EP2,757,037, and Japanese Patent Application No. JP2013100013A also provide background information and are incorporated by reference in entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure generally relates to a device for coupling a propulsor to a marine vessel. A rail is configured for attachment to the marine vessel. A carriage is moveable relative to the rail into first and second positions. A shaft has a first end pivotally coupled to the marine vessel and a second end for coupling to the propulsor. An actuator is configured to pivot the shaft relative to the marine vessel to thereby move the propulsor into and between stowed and deployed positions. A lock is manually operable to fix the carriage in the first position in which the actuator prevents manual pivoting of the shaft and alternatively in the second position in which the shaft is permitted to be manually pivoted.

The present disclosure further relates a method for making a device for coupling a propulsor to a marine vessel. The method includes configuring a rail to be attachable to the marine vessel and engaging a carriage with the rail such that the carriage is moveable into first and second positions. The method further includes pivotally coupling a shaft at a first end thereof to the marine vessel. A second end of the shaft is configured for coupling to the propulsor. The method further includes configuring an actuator to pivot the shaft relative to the marine vessel to thereby move the propulsor into and between stowed and deployed positions. The method further includes configuring a lock to be manually operable to fix the carriage in the first position in which the actuator prevents manual pivoting of the shaft and alternatively in the second position in which the shaft is permitted to be manually pivoted.

In some embodiments according to the present disclosure, the rail includes opposing c-channels that each define an engaged opening and a disengaged opening therein. The carriage is positioned within the opposing c-channels to slide therein along a longitudinal axis, where the opposing c-channels prevent the carriage from moving in transverse and vertical axes that are perpendicular to each other and to the longitudinal axis, and where a carriage opening is defined through the carriage parallel to the transverse axis. In certain embodiments, the actuator is pivotally coupled to the carriage. In certain embodiments, a pin is configured to select between the actuator being engaged and disengaged, where the actuator is engaged when the pin is received through engaged openings in the rails and the carriage opening such that the pin prevents the carriage from sliding along the rail, and the actuator system is disengaged when the pin is withdrawn from the engaged openings in the rails and the carriage opening, where the shaft is manually pivotable only when the actuator is disengaged.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The present inventors have recognized a problem with bow thrusters presently known in the art, and particularly those that are retractable (or stowable) for storage. Specifically, within the context of a marine vessel having pontoons, there is insufficient clearance between the pontoons to accommodate a propulsive device, and particularly a propulsor oriented to create propulsion in the port-starboard direction. The problem is further exacerbated when considering how marine vessels are trailered for transportation over the road. One common type of trailer is a scissor type lift in which bunks are positioned between the pontoons to lift the vessel by the underside of the deck. An exemplary lift of this type is the "Scissor Lift Pontoon Trailer" manufactured by Karavan in Fox Lake, WI In this manner, positioning a bow thruster between a marine vessel's pontoons either precludes the use of a scissor lift trailer, or leaves so little clearance that damage to the bow thruster and/or trailer is likely to occur during insertion, lifting, and/or transportation of the vessel on the trailer. As such, the present inventors have realized it would be advantageous to rotate the propulsor in a fore-aft orientation when stowed to minimize the width of the bow thruster. Additionally, the present inventors have recognized the desirability of developing such a rotatable propulsor that does not require additional actuators for this rotation, adding cost and complexity to the overall system.

Figure 1:
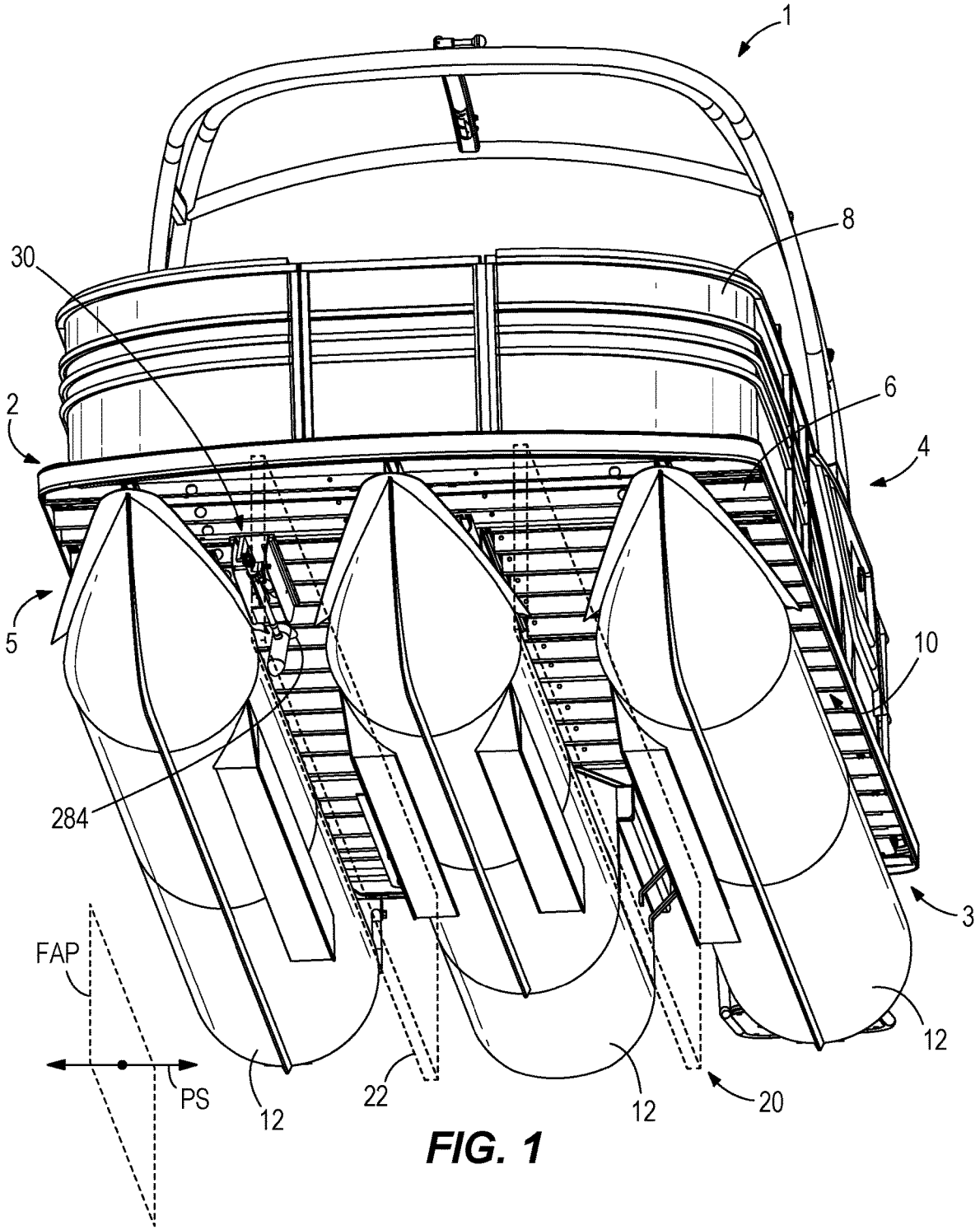
FIG. 1 is an isometric bottom view of a propulsion device coupled to a marine vessel and having a propulsor.

FIG. 1 depicts the underside of a marine vessel 1 as generally known in the art, but outfitted with an embodiment of a propulsion device 30 according to the present disclosure. The marine vessel 1 extends between a bow 2 and a stern 3, as well as between port 4 and starboard 5 sides, thereby defining a fore-aft plane FAP, and port-starboard direction PS. The marine vessel 1 further includes a deck 6 with a rail system 8 on top and pontoons 12 mounted to the underside 10 of the deck 6. The marine vessel 1 is shown with a portion of a scissor type lift 20, specifically the bunks 22, positioned between pontoons 12 to lift and support the marine vessel 1 for transportation over land in a manner known in the art. As is discussed further below, embodiments of a novel propulsion device 30 have a propeller 284 that faces the underside 10 of the deck 6 when stowed, in contrast to during use to propel the marine vessel 1 in the water as a bow thruster. This is distinguishable from propulsors known in the art, in which the propeller faces the pontoons. In prior art configurations, there typically is insufficient room between the propulsor and the pontoons to fit the bunks of the scissor type lift without risking damage to the propulsor while inserting the bunks, lifting the marine vessel, and/or traveling on the road.

Figure 2:
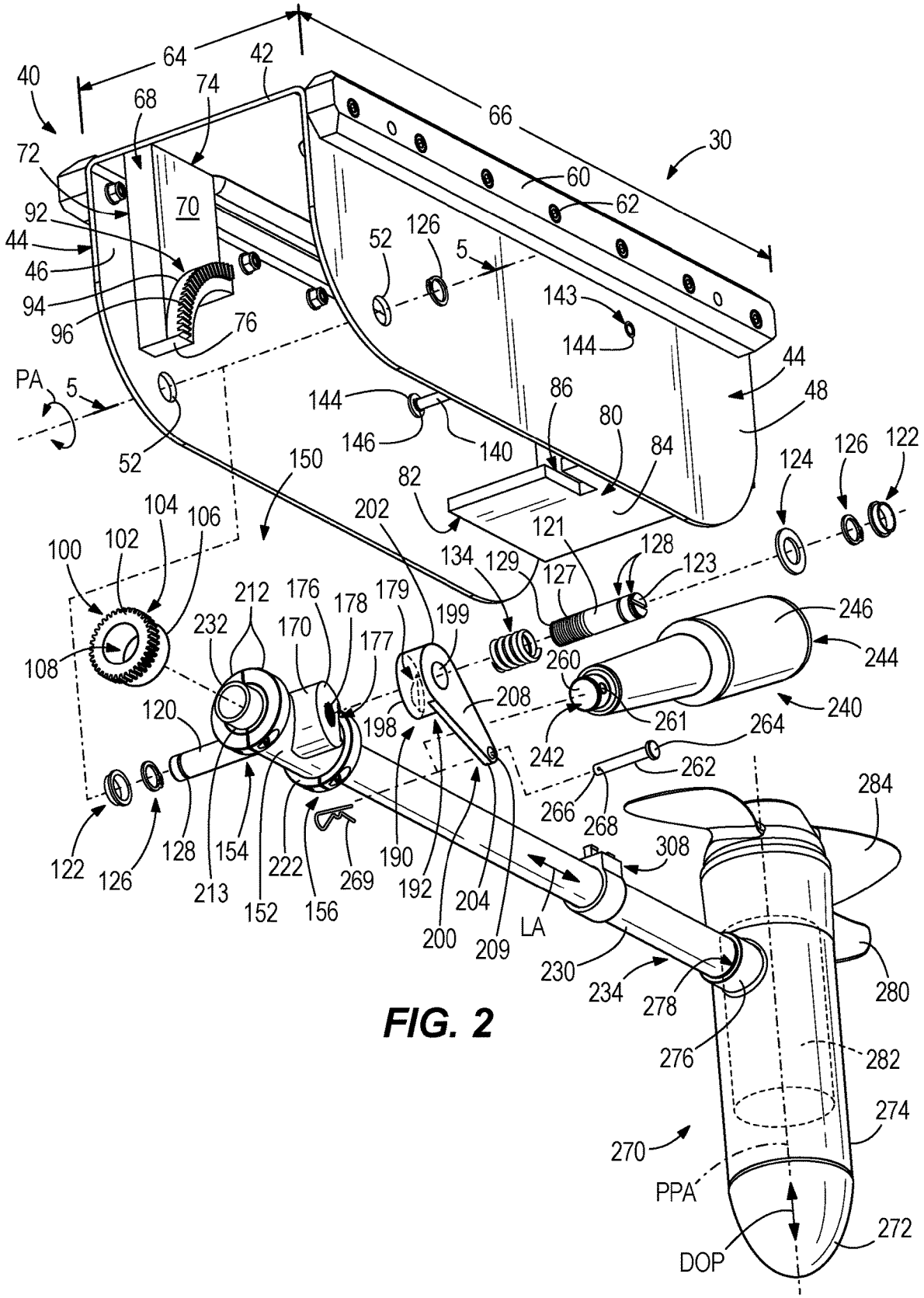
FIG. 2 is an exploded isometric view showing the propulsor from FIG. 1 in a stowed position.
Figure 3:
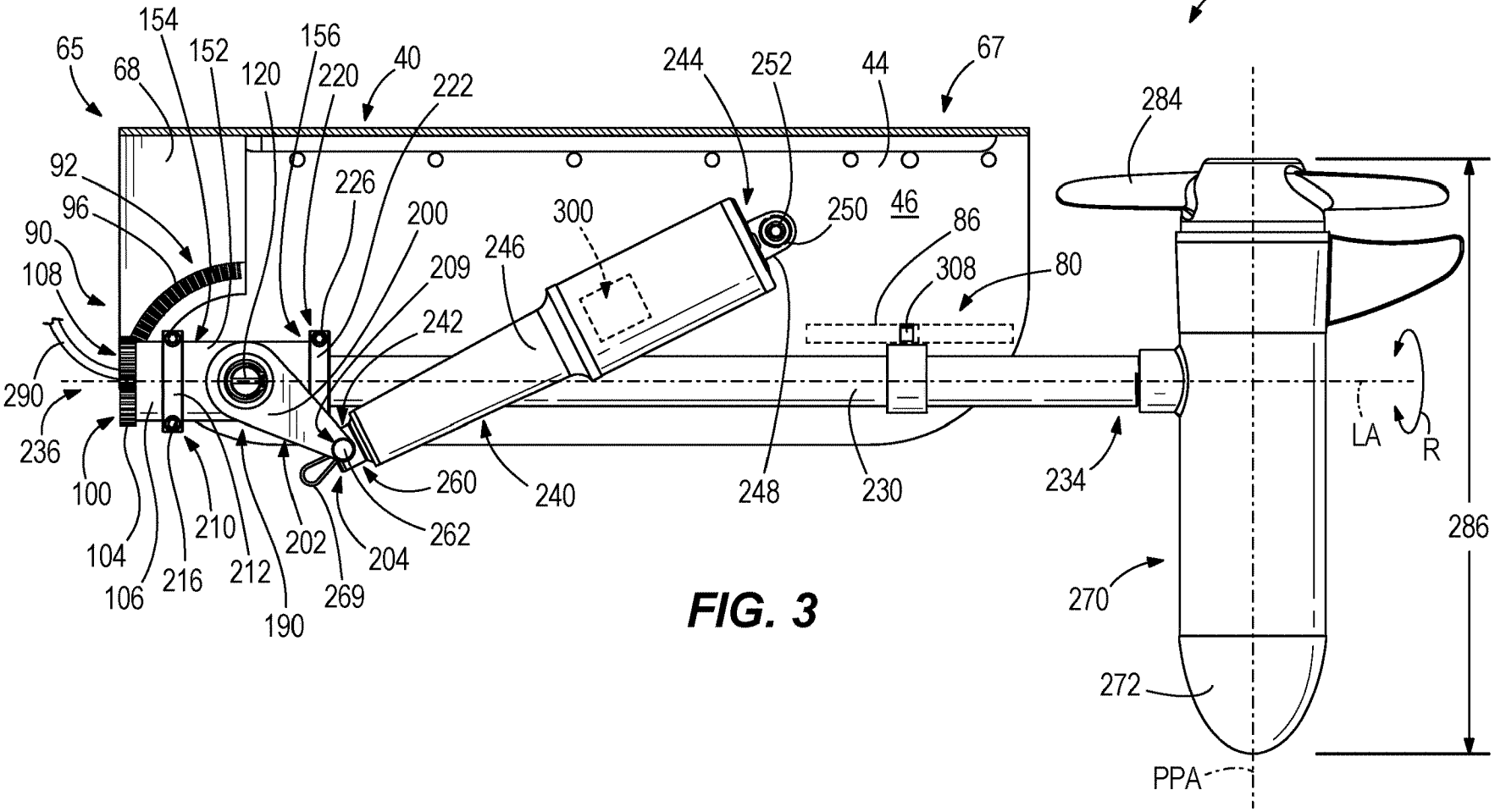
FIG. 3 is a sectional side view taken along the line 3-3 in FIG. 2.
Figure 4:
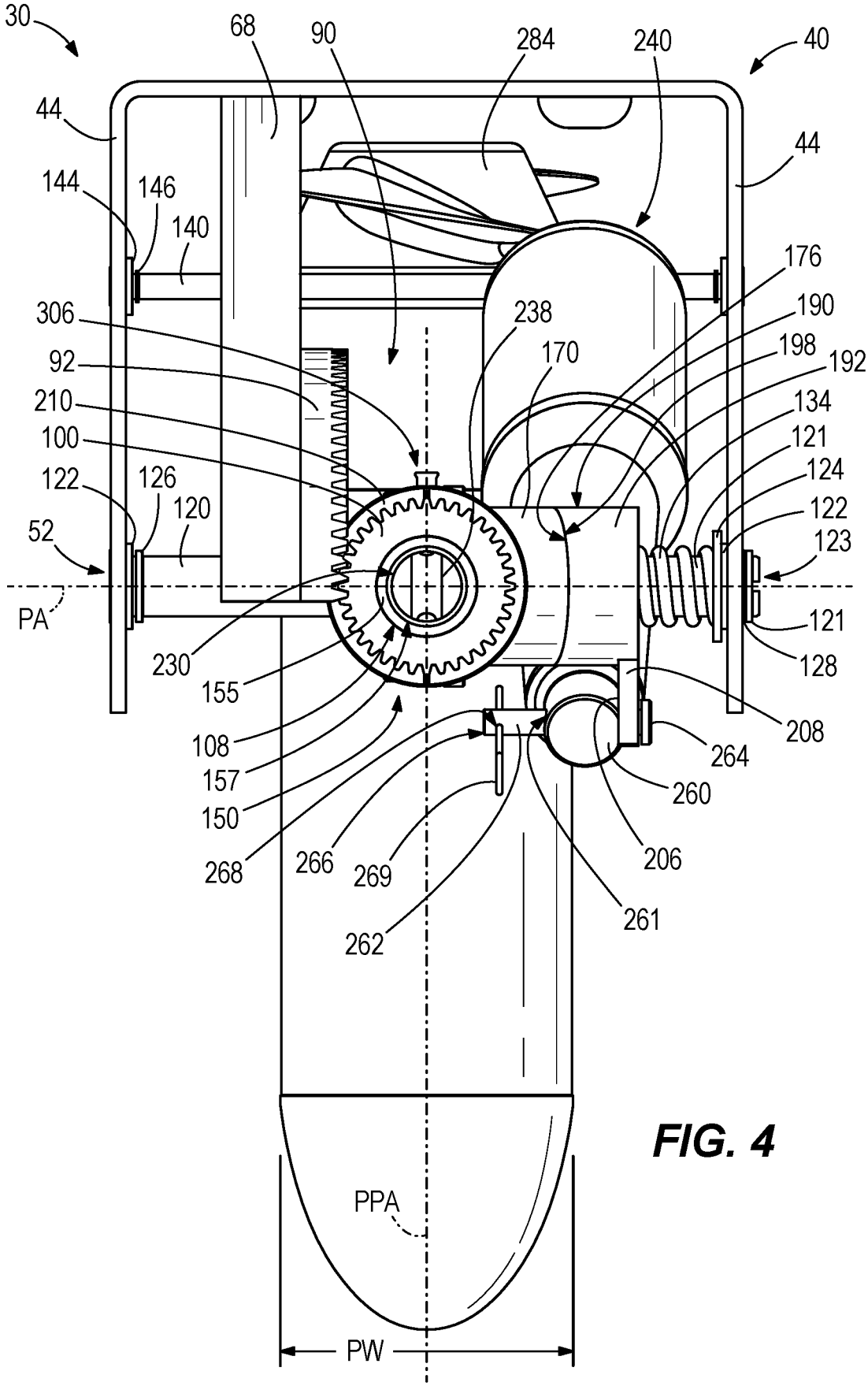
FIG. 4 is a rear view of the propulsion device shown in FIG. 2.

FIGS. 2-3 depict an exemplary propulsion device 30 according to the present disclosure, here oriented in a stowed position. The propulsion device 30 includes a base 40 having a top 42 with sides 44 extending perpendicularly downwardly away from the top 42. The sides 44 include an inward side 46 and outward side 48 and extend between a first end 65 and second end 67 defining a length 66 therebetween. A width 64 is defined between the sides 44. A stop 80 having sides 82 and a bottom 84 is coupled between the sides 44 of the base 40. A leg 68 having an inward side 70 and outward side 72 extends between a top end 74 and a bottom end 76. The leg 68 is coupled at the top end 74 to the top 42 of the base 40 and extends perpendicularly downwardly therefrom. A stationary gear 92 having a mesh face 96 with gear teeth and an opposite mounting face 94 is coupled to the leg 68 with the mounting face 94 facing the inward side 70 of the leg 68. As shown in FIG. 4, one or more support rods 140 may also be provided between the sides 44 and received within support rod openings 143 defined therein to provide rigidity to the base 40. In the example shown, the support rod 140 is received within a bushing 144 and held in position by a snap ring 146 received within a groove defined within the support rod 140.

Returning to FIGS. 2-3, the base 40 is configured to be coupled to the marine vessel 1 with the top 42 facing the underside 10 of the deck 6. The base 40 may be coupled to the deck 6 using fasteners and brackets presently known in the art. A mounting bracket 60 is coupled via fasteners 62 (e.g., screws, nuts and bolts, or rivets) to the outward sides 48 of the sides 44 of the base 40. The mounting bracket 60 is receivable in a C-channel bracket or other hardware known in the art (not shown) that is coupled to the deck 6 and/or pontoons 12 to thereby couple the propulsion device 30 thereto.

As shown in FIGS. 2-4, the propulsion device 30 includes a shaft 230 that extends between a proximal end 232 and distal end 234 defining a length axis LA therebetween. The proximal end 232 of the shaft 230 is non-rotatably coupled to a moving gear 100. The moving gear 100 has a proximal face 102 and mesh face 104 having gear teeth, where the mesh face 104 engages with the mesh face 96 of the stationary gear 92 to together form a gearset 90 as discussed further below. The moving gear 100 further includes a barrel 106 that extends perpendicularly relative to the proximal face 102 and is coupled to the shaft 230 in a manner known in the art (e.g., via a set screw or welding). In this manner, the moving gear 100 is fixed to the shaft 230 such that rotation of the moving gear 100 causes rotation of the shaft 230 about the length axis LA.

Figure 5:
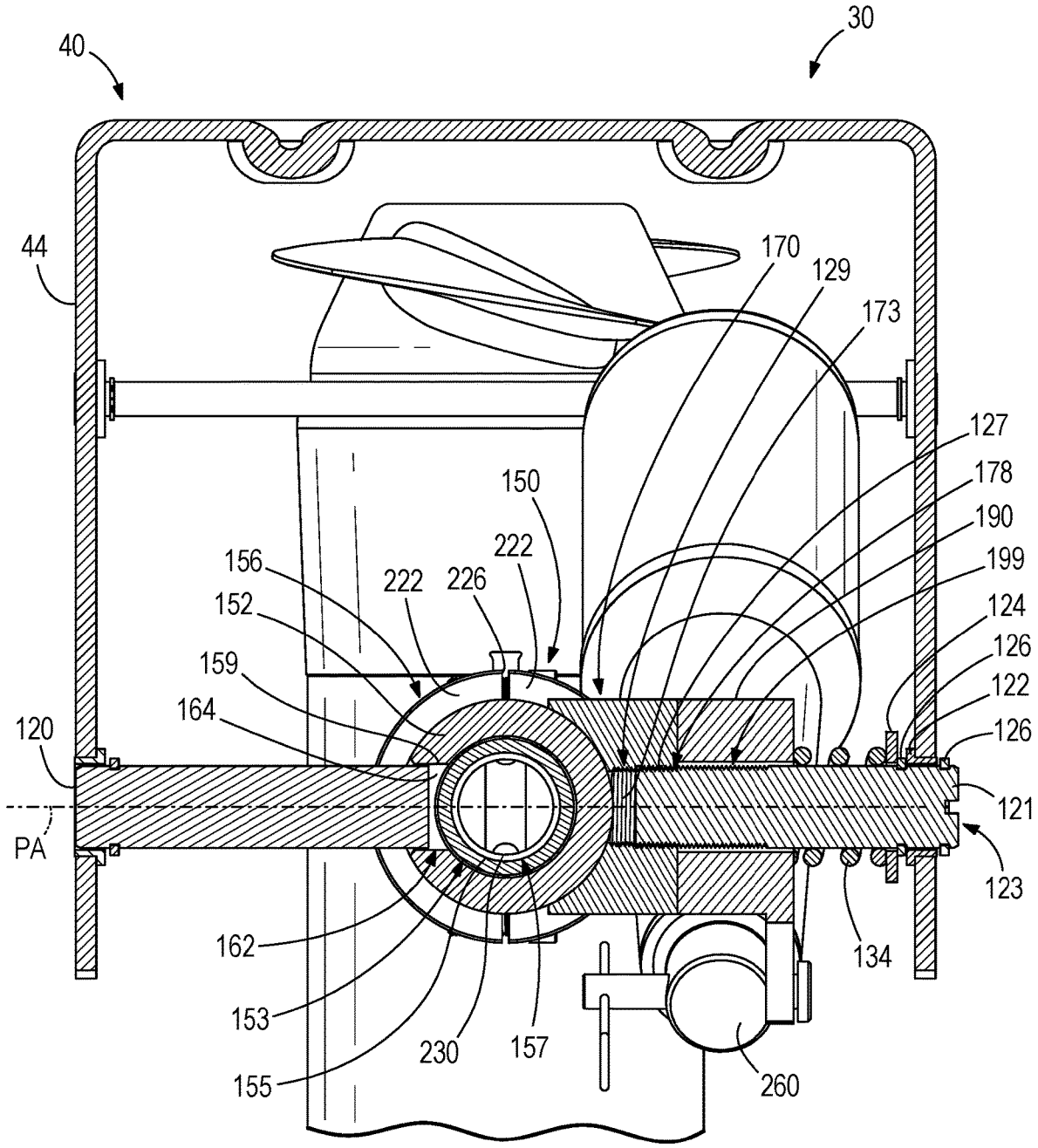
FIG. 5 is a sectional view taken along the line 5-5 of FIG. 2.
Figure 6:
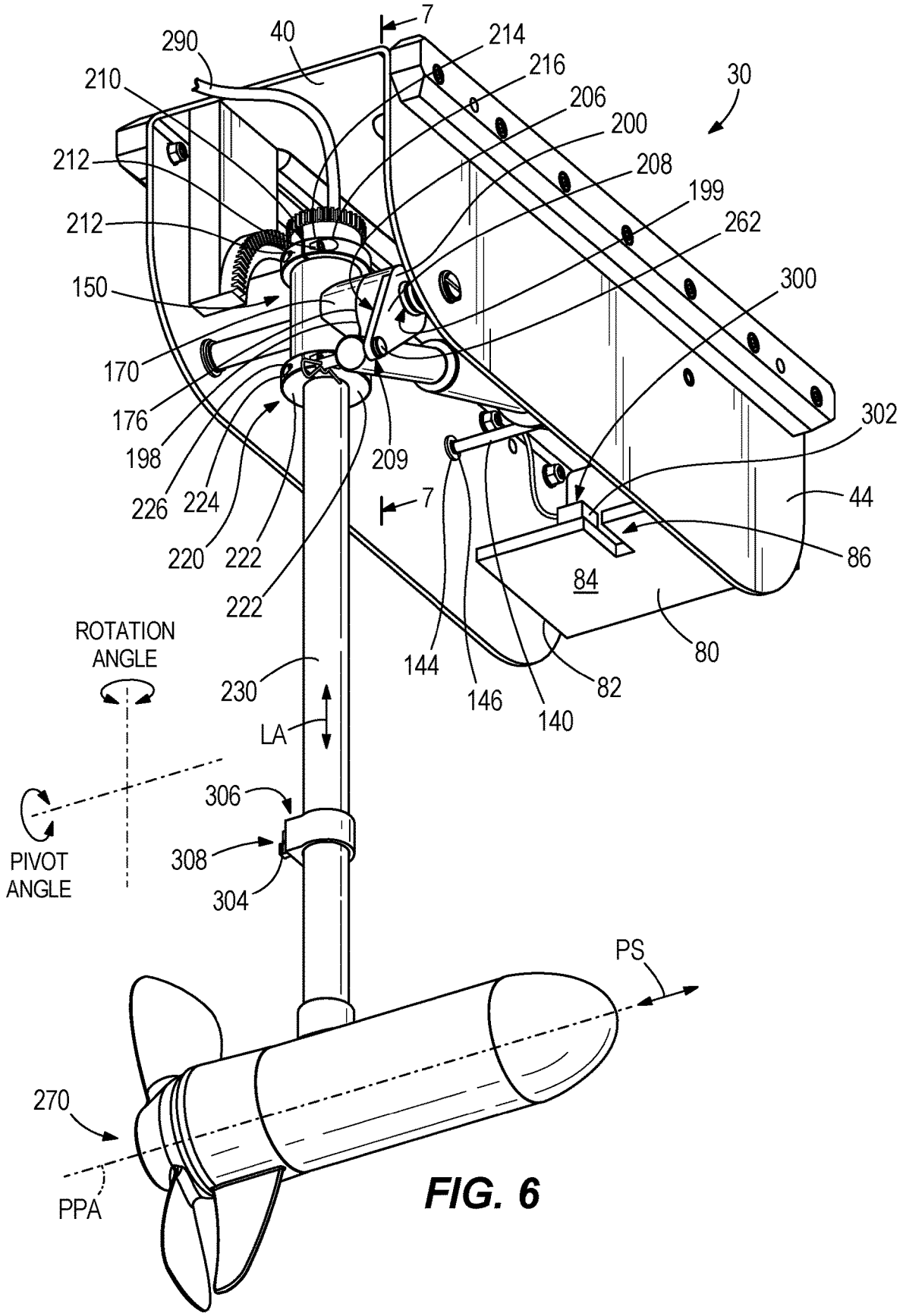
FIG. 6 is an isometric bottom view showing the propulsor from FIG. 2 in a deployed position.
Figure 7:
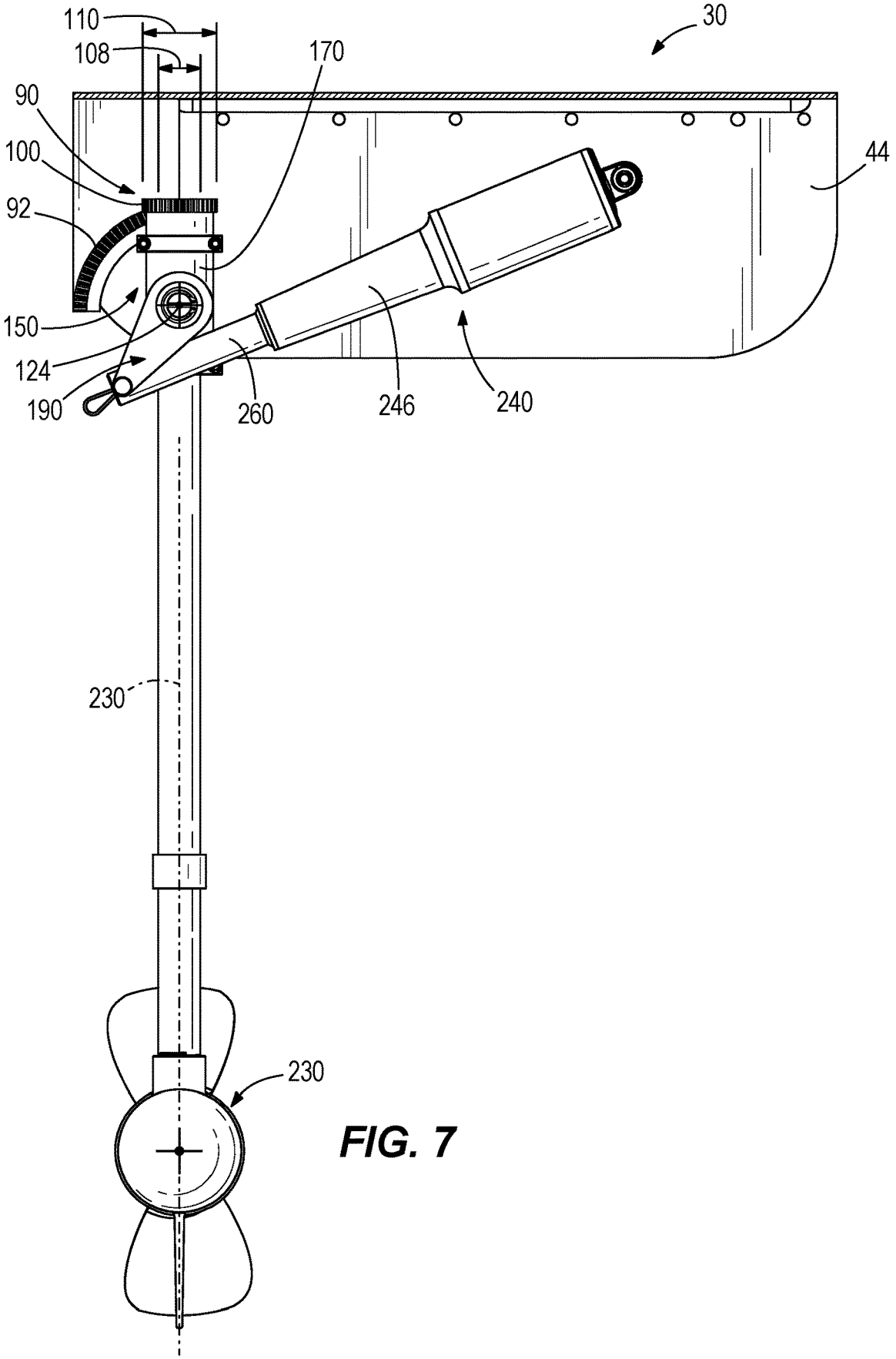
FIG. 7 is a sectional side view taken along the line 7-7 in FIG. 6.
Figure 8:
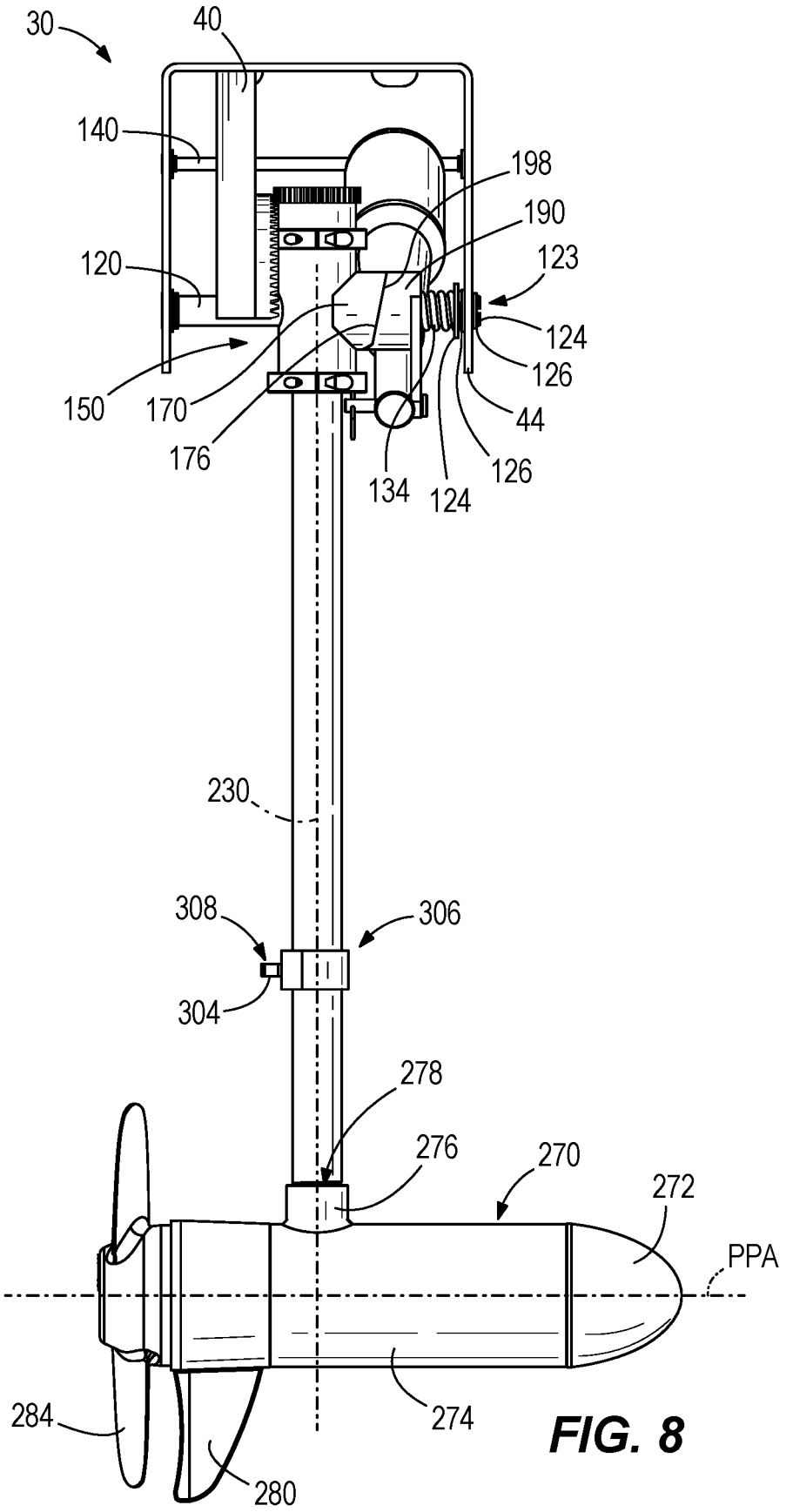
FIG. 8 is a rear view of the propulsion device as shown in FIG. 6.

With reference to FIGS. 2 and 5-6, a pivot rotation device 150 is coupled to the shaft 230 near its proximal end 232, below the moving gear 100. The pivot rotation device 150 includes a main body 152 extending between a first end 154 and a second end 156 with an opening 153 defined therebetween. The shaft 230 is received through the opening 153 between the first end 154 and second end 156 of the main body 152 and rotatable therein. In the embodiment shown, a bushing 155 is received within the opening 153 of the main body 152 and the shaft 230 extends through an opening 157 within the bushing 155. The bushing 155 provides for smooth rotation between the shaft 230 and the main body 152. The shaft 230 is retained within the main body 152 via first and second clamp systems 210, 220. The first clamp system 210 includes two clamp segments 212 coupled together by fasteners 216 received within openings and receivers therein, for example threaded openings for receiving the fasteners 216. The clamp segments 212 are configured to clamp around the shaft 230 just above the main body 152, in the present example with a gasket 213 sandwiched therebetween to provide friction. Likewise, clamp segments 222 of the second clamp system 220 are coupled to each other via fasteners 226 to clamp onto the shaft just below the main body 152, which may also include a gasket sandwiched therebetween. In this manner, the shaft 230 is permitted to rotate within the main body 152, but the first and second clamp systems 210, 220 on opposing ends of the main body 152 prevent the shaft 230 from moving axially through the main body 152.

As shown in FIGS. 2-3 and 5, the shaft 230 is pivotable about a transverse axis (shown as pivot axis PA) formed by coaxially-aligned pivot axles 120, 121. The pivot axles 120, 121 are received within pivot axle openings 52 defined within the sides 44 of the base 40, with bushings 122 therebetween to prevent wear. Snap rings 126 are receivable within grooves 128 defined within the pivot axles 120, 121 to retain the axial position of the pivot axles 120, 121 within the base 40. The interior ends of the pivot axles 120, 121 are received within the main body 152 of the pivot rotation device 150 coupled to the shaft 230. The pivot axle 120 is received within a pivot axle opening 162 of the main body 152 such that the outer surface of the pivot axle 120 engages an interior wall 159 of the main body 152. In the embodiment of FIG. 5, a gap 164 remains at the end of the pivot axle 120 to allow for tolerancing and bending and/or movement of the sides 44 of the base 40.

With continued reference to FIG. 5, the pivot rotation device 150 further includes an extension body 170 that extends away from the main body 152. The extension body 170 defines a pivot axle opening 178 therein for receiving the pivot axle 121. The pivot axle 121 has an insertion end 129 with threads 127 defined thereon, which engage with threads 173 of the pivot axle opening 178 defined in the extension body 170. A slot 123 is defined in the end of the pivot axle 121 opposite the insertion end 129. The pivot axle 121 is therefore threadably received within the extension body 170 by rotating a tool (e.g., a flathead screwdriver) engaged within the slot 123 defined in the end of the pivot axle 121. A snap ring 126 may also be incorporated and receivable within grooves 128 defined in the pivot axle 121 to prevent axial translation of the pivot axle 121 relative to the sides 44 of the base 40.

As shown in FIG. 2, a face 176 of the extension body 170 defines a notch 177 recessed therein, which as will become apparent provides for non-rotational engagement with a pivot arm 190. The pivot arm 190 includes a barrel portion 192 having a face 198 with a protrusion 179 extending perpendicularly away from the face 198. The protrusion 179 is received within the notch 177 when the faces 176, 198 abut each other to rotationally fix the pivot arm 190 and the extension body 170. It should be recognized that other configurations for rotationally fixing the pivot arm 190 and extension body 170 are also contemplated by the present disclosure, for example other keyed arrangements or fasteners.

The barrel portion 192 of the pivot arm 190 further defines a pivot axle opening 199 therethrough, which enables the pivot axle 121 to extend therethrough. The pivot arm 190 further includes an extension 200 that extends away from the barrel portion 192. The extension 200 extends from a proximal end 202 coupled to the barrel portion 192 to distal end 204, having an inward face opposite an outward face 208. A mounting pin opening 209 is defined through the extension 200 near the distal end 204, which as discussed below is used for coupling the pivot arm 190 to an actuator 240.

As shown in FIGS. 2 and 4, the pivot arm 190 is biased into engagement with the main body 152 of the pivot rotation device 150 via a biasing device, such as a spring 134. In the example shown, the spring 134 is a coil or helical spring that engages the outward face 208 of the extension 200 of the pivot arm 190 at one end and engages a washer 124 abutting a snap ring 126 engaged within a groove of the pivot axle 121 at the opposite end. In this manner, the spring 134 provides for a biasing force engaging the pivot arm 190 and the main body 152 such that the faces 176, 198 thereof remain in contact during rotation of the pivot arm 190, but also provides a safeguard. For example, if the shaft 230 experiences an impact force (e.g., a log strike), the presently disclosed configuration allows the protrusion 179 (shown here to have a rounded shape) to exit the notch 177 against the biasing force of the spring 134 to prevent the force from damaging other components, such as the actuator 240 coupled to the pivot arm 190 (discussed further below).

Referring to FIGS. 2-4, the propulsion device 30 further includes an actuator 240 (presently shown is a linear actuator), which for example may be an electric, pneumatic, and/or hydraulic actuator presently known in the art. The actuator 240 extends between a first end 242 and second end 244 and has a stationary portion 246 and an extending member 260 that extends from the stationary portion 246 in a manner known in the art. The stationary portion 246 includes a mounting bracket 248 that is coupled to the base 40 via fasteners 252, such as bolts, for example. At the opposite end of the actuator 240, a mounting pin opening 261 extends through the extending member 260, which is configured to receive a mounting pin 262 therethrough to couple the extending member 260 to the pivot arm 190 of the pivot rotation device 150. The mounting pin 262 shown extends between a head 264 and an insertion end 266, which in the present example has a locking pin opening 268 therein for receiving a locking pin 269. The locking pin 269, for example a cotter pin, is inserted or withdrawn to removably retain the mounting pin 262 in engagement between the actuator 240 and the pivot arm 190. In the embodiment of FIGS. 2-4, it should be recognized that actuation of the actuator 240 thus causes pivoting of the shaft 230 about the pivot axis PA.

Referring to FIG. 2, the propulsion device 30 further includes a propulsor 270 coupled to the distal end 234 of the shaft 230. The propulsor 270 may be of a type known in the art, such as an electric device operable by battery. In the example shown, the propulsor 270 includes a nose cone 272 extending from a main body 274. The main body 274 includes an extension collar 276 that defines a shaft opening 278, whereby the shaft 230 is received within the shaft opening 278 for coupling the shaft 230 to the propulsor 270. The propulsor 270 includes a motor 282 therein, whereby control and electrical power may be provided to the motor 282 by virtue of a wire harness 290 (FIG. 9 also referred to as a wire) extending through the shaft 230, in the present example via the opening 108 defined through the moving gear 100; however, it should be recognized that the wire harness 290 may enter the shaft 230 or propulsor 270 in other locations. In some configurations, the wire harness 290 also extends through a gasket 291 (FIG. 9) that prevents ingress of water or other materials into the shaft 230, for example. The propulsor 270 further includes a fin 280 and is configured to rotate the propeller 284 about a propeller axis PPA. The propulsor 270 extends a length 286 (FIG. 3) and provides propulsive forces in a direction of propulsion DOP. With reference to FIG. 4, the propulsor 270 has a width PW that is perpendicular to the length 286, in certain embodiments the width PW being less than the width 64 of the base 40.

As shown in FIG. 6 and discussed further below, the propulsor 270 is configured to propel the marine vessel 1 through the water in the port-starboard direction PS when the shaft 230 is positioned in the deployed position. It should be recognized that, for simplicity, the propulsor 270 is described as generating propulsion in the port-starboard direction, and thus that the marine vessel moves in the port-starboard direction. However in certain configurations, the propulsor 270 may accomplish this movement of the marine vessel in the port-starboard direction by concurrently using another propulsor coupled elsewhere on the marine vessel 1, for example to provide translation rather than rotation of the marine vessel 1.

It should be recognized that when transitioning the shaft 230 and propulsor 270 from the stowed position of FIG. 3 to the deployed position of FIG. 6, the shaft 230 pivots 90 degrees about the pivot axis PA from being generally horizontal to generally vertical, and the propulsor 270 rotates 90 degrees about the length axis LA of the shaft 230 from the propeller axis PPA being within the fore-aft plane FAP (FIG. 1) to extending in the port-starboard direction PS. The present inventors invented the presently disclosed propulsion devices 30 wherein pivoting of the shaft 230 about the pivot axis PA automatically correspondingly causes rotation of the shaft 230 about is length axis LA without the need for additional actuators (both being accomplished by the same actuator 240 discussed above). With reference to FIGS. 2-3, this function is accomplished through a gearset 90, which as discussed above is formed by the engagement of the stationary gear 92 and moving gear 100.

As discussed above, the stationary gear 92 is fixed relative to the base 40 and the moving gear 100 rotates in conjunction with the shaft 230 rotating about its length axis LA. In this manner, as the shaft 230 is pivoted about the pivot axis PA via actuation of the actuator 240, the engagement between the mesh face 96 of the stationary gear 92 and the mesh face 104 of the moving gear 100 causes the moving gear 100 to rotate, since the stationary gear 92 is fixed in place. This rotation of the moving gear 100 thus causes rotation of the moving gear 100, which correspondingly rotates the shaft 230 about its length axis LA. Therefore, the shaft 230 is automatically rotated about its length axis LA when the actuator 240 pivots the shaft 230 about the pivot axis PA. It should be recognized that by configuring the mesh faces 96, 104 of the gears accordingly (e.g., numbers and sizes of gear teeth), the gearset 90 may be configured such that pivoting the shaft 230 between the stowed position of FIG. 4 and the deployed position of FIG. 6 corresponds to exactly 90 degrees of rotation for the shaft 230 about its length axis LA, whether or not the shaft 230 is configured to pivot 90 degrees between its stowed and deployed positions. It should be recognized that other pivoting and/or rotational angles are also contemplated by the present disclosure.

The present inventors invented the presently disclosed configurations, which advantageously provide for propulsion devices 30 having a minimal width 64 (FIG. 2) when in the stowed position, clearing the way for use of a scissor type lift 20 or other lifting mechanisms for the marine vessel 1, while also positioning the propulsor for generating thrust in the port-starboard direction PS when in the deployed position.

As shown in FIG. 6, certain embodiments include stop 80 within the base 40 for stopping, centering, and/or securing the shaft 230 in the stowed position. In the embodiment shown, a centering slot 86 is defined within the bottom 84 of the stop 80. This centering slot 86 is configured to receive a tab 308 that extends from a clamp 306 positioned at a midpoint along the shaft 230. When the shaft 230 is pivoted and rotated into its stowed position as shown in FIG. 2, the tab 308 of the clamp 306 is received within the centering slot 86 of the stop 80, whereby the bottom 84 of the stop 80 itself prevents further upward pivoting of the shaft 230, and whereby the centering slot 86 prevents lateral movement of the propulsor 270 when in the stowed position.

The embodiment of FIG. 6 further depicts a positional sensor 300 configured for detecting whether the propulsion device 30 is in the stowed position. The positional sensor 300 shown includes a stationary portion 302 and a moving portion 304, whereby the stationary portion 302 is a Hall Effect Sensor positioned adjacent to the centering slot 86 of the stop 80, which detects the moving portion 304 integrated within the tab 308. In this manner, the positional sensor 300 detects when the shaft 230 is properly in the stowed position, and when it is not.

It should be recognized that other positional sensors 300 are also known in the art and may be incorporated within the systems presently disclosed. For example, FIG. 3 depicts an embodiment in which the positional sensor 300 is incorporated within the actuator 240, such as a linear encoder, that can be used to infer the position of the shaft 230 via the position of the extending member 260 of the actuator 240 relative to the stationary portion 246. An exemplary positional sensor 300 is Mercury Marine's Position Sensor ASM, part number 8M0168637, for example.

Figure 9:
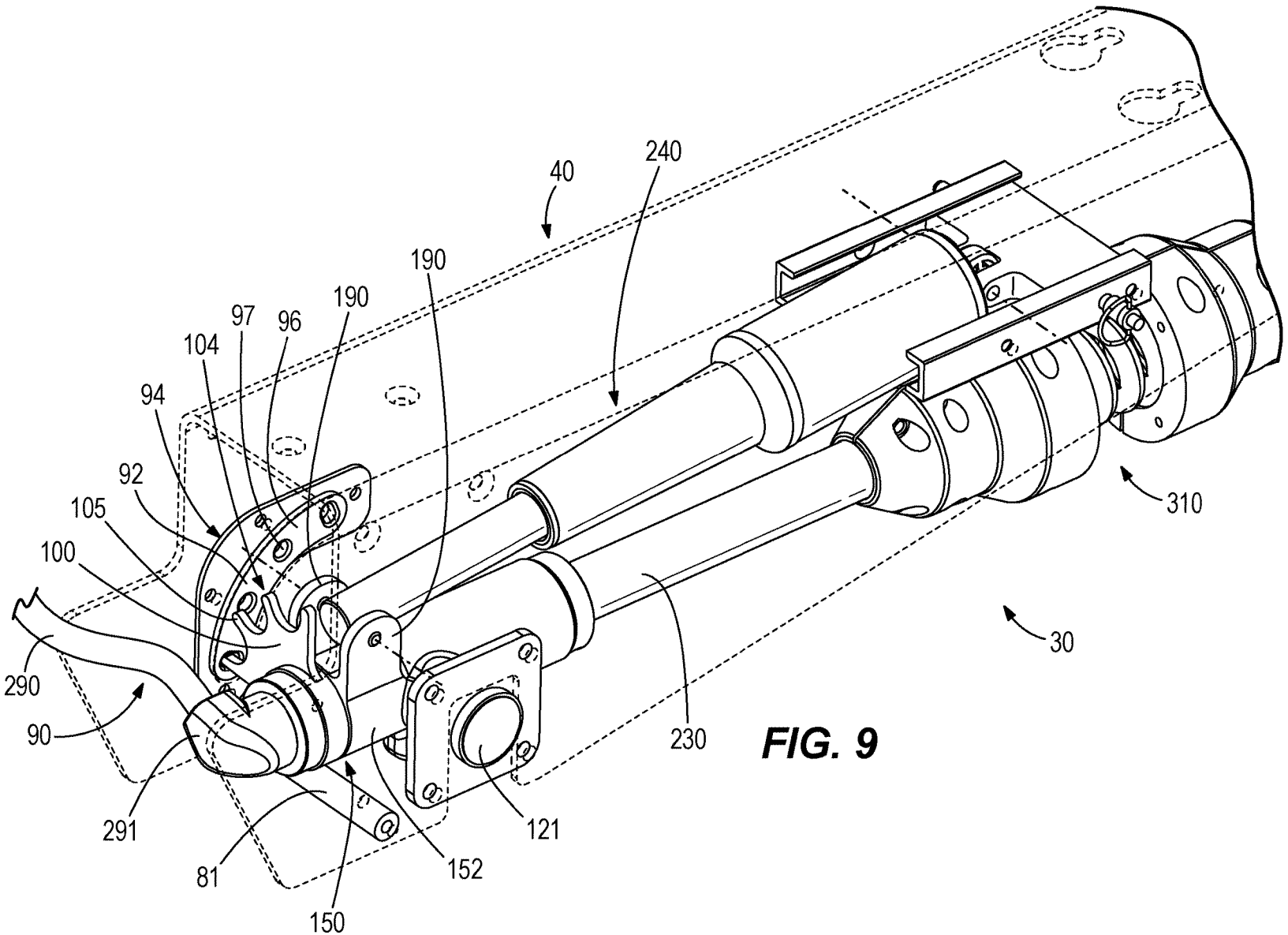
FIG. 9 is an isometric view of an alternate embodiment of propulsion device coupled to a marine vessel and having a propulsor.

The present disclosure contemplates other embodiments of propulsion devices 30. For example, FIG. 9 depicts an embodiment having two pivot arms 190 coupled directly to the main body 152 of the pivot rotation device 150. The actuator 240 is pivotally coupled to the two pivot arms 190 in a similar manner as that discussed above. In certain examples, the two pivot arms 190 are integrally formed with the clamp segments 212 of the first clamp system 210, for example. The gearset 90 of the embodiment in FIG. 9 also varies from that discussed above. Specifically, the mesh face 96 of the stationary gear 92 includes openings 97 rather than gear teeth. These openings 97 are configured to receive fingers 105 that extend from the mesh face 104 of the moving gear 100, generally forming a gear and sprocket type system for the gearset 90. The embodiment shown also includes a stop rod 81 for preventing the shaft 230 from rotating too far, or in other words past the deployed position.

Figure 10:
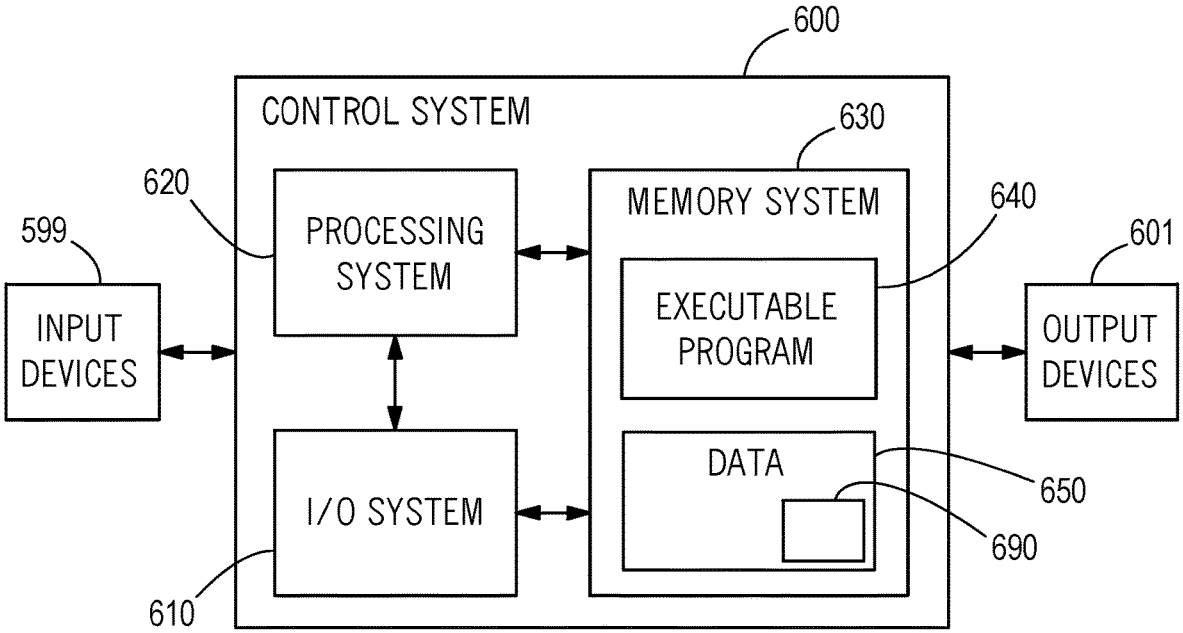
FIG. 10 depicts an exemplary control system for controlling propulsion devices according to the present disclosure.

FIG. 10 depicts an exemplary control system 600 for operating controlling the propulsion device 30. In certain examples, the control system 600 communicates with each of the one or more components of the propulsion device 30 via a communication link CL, which can be any wired or wireless link. The control system 600 is capable of receiving information and/or controlling one or more operational characteristics of the propulsion device 30 and its various sub-systems by sending and receiving control signals via the communication links CL. In one example, the communication link CL is a controller area network (CAN) bus; however, other types of links could be used. The control system 600 of FIG. 10 may be a computing system that includes a processing system 610, memory system 620, and input/output (I/O) system 630 for communicating with other devices, such as input devices 599 and output devices 601, either of which may also or alternatively be stored in a cloud 602. The processing system 610 loads and executes an executable program 622 from the memory system 620, accesses data 624 stored within the memory system 620, and directs the propulsion device 30 to operate as described in further detail below.

The processing system 610 may be implemented as a single microprocessor or other circuitry, or be distributed across multiple processing devices or sub-systems that cooperate to execute the executable program 622 from the memory system 620. The memory system 620 may comprise any storage media readable by the processing system 610 and capable of storing the executable program 622 and/or data 624. The memory system 620 may be implemented as a single storage device, or be distributed across multiple storage devices or sub-systems that cooperate to store computer readable instructions, data structures, program modules, or other data. The memory system 620 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

Through experimentation and development, the present inventors have identified issues with propulsion devices presently known in the art, including those with a moveable shaft for moving the propulsor between stowed and deployed positions. In particular, problems arise in circumstances in which an actuator moving the shaft becomes inoperable, through damage, loss of power, and/or the like. For example, in the embodiment of FIG. 3 discussed above, the actuator 240 extends and retracts to cause the shaft 230 to pivot about the pivot axis 120. If the length of this actuator 240 becomes fixed through inoperability, the actuator 240 essentially locks the shaft 230 in position such that the shaft 230 may no longer rotate. This prevents the operator from stowing the propulsor 270, and thus preventing the operator from trailering the marine vessel 1 or entering shallow waters without causing damage to the propulsor and/or propulsion device more generally. A propulsor 270 stuck in the deployed position (or an intermediate position) may also prevent normal operation of the marine vessel 1, for example creating resistance when the marine vessel 1 is underway using another propulsor. Likewise, operating the marine vessel 1 via another propulsor may cause damage to the propulsion device 30 if left in the deployed position.

Figure 11:
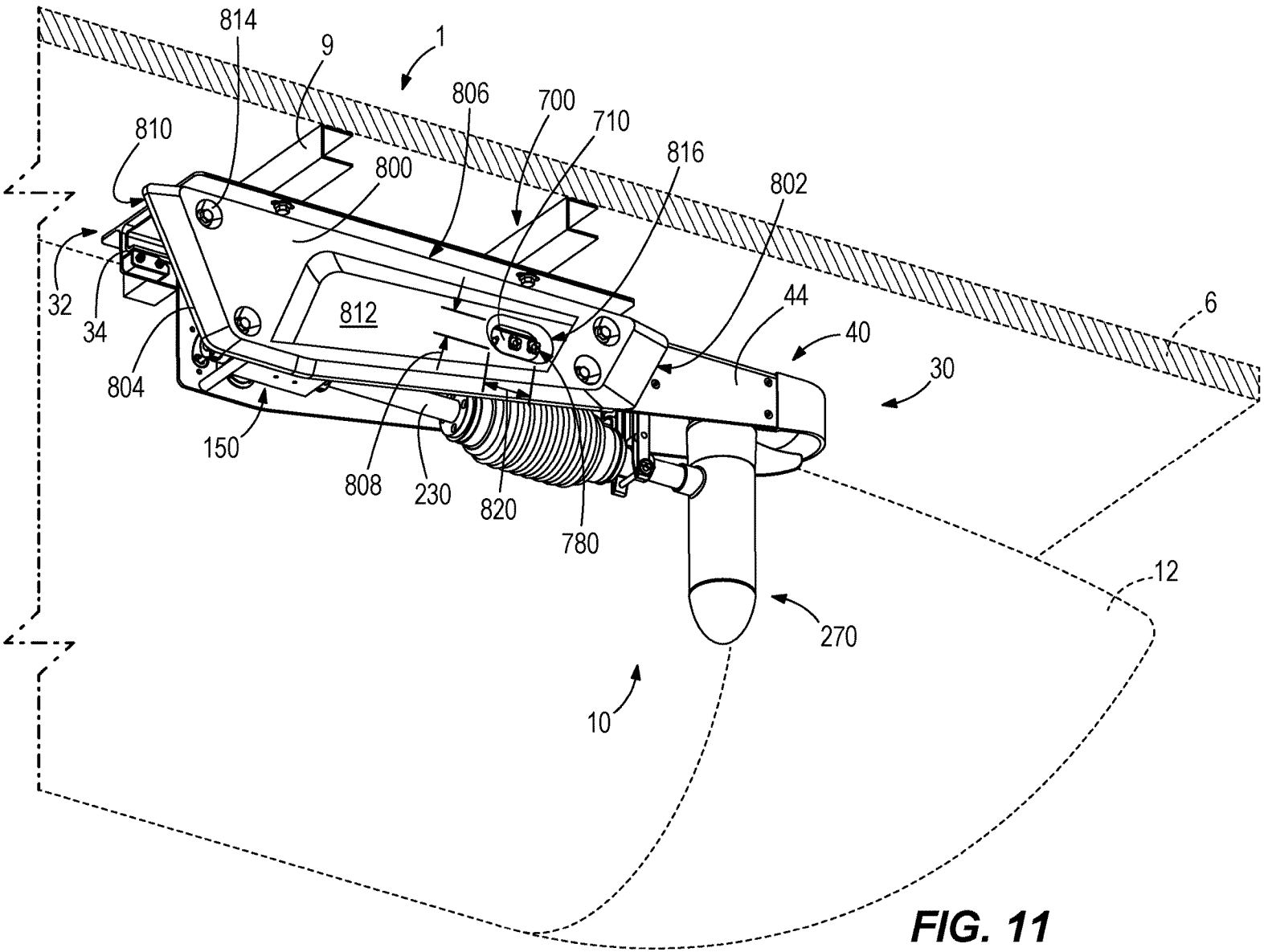
FIG. 11 depicts an isometric bottom-right view of one embodiment of a device for coupling a propulsor to a marine vessel according to the present disclosure.

The present inventors have invented the presently disclosed devices and methods for coupling propulsors to a marine vessel in a manner that allows the operator to manually disengage the actuator, thus permitting the propulsor to be manually stowed even when the actuator is inoperable. FIG. 11 depicts one embodiment of a device 700 for coupling a propulsor 270 to a marine vessel 1 according to the present disclosure. The device 700 includes many of the elements of the propulsion devices 30 discussed above, such as a base 40 coupled to sides 34 of a mounting bracket 32. The mounting bracket 32 is coupled to crossmembers 9 of the deck 6 for the marine vessel 1, for example using fasteners such as nuts and bolts. A shaft 230 is pivotally (and in this example, also rotatably) coupled to the base 40 via a pivot rotation device 150 in a manner described above. The propulsor 270 is coupled to the shaft 230 as described above.

The device 700 of FIG. 11 includes a cover 800 providing an attractive exterior and also protection for components within the device 700. The cover 800 extends between a front 802 and a back 804, a top 806 and a bottom 808, and an inside 810 and an outside 812. The cover 800 is coupled to the mounting base 40 in a manner known in the art, such as via fasteners extending through openings 814 in the cover 800 and received within the sides 44 the mounting base 40. Exemplary fasteners include bolts or machine screws received within threaded openings defined in the sides 44 the mounting base 40, nuts and bolts, adhesives between the inside 810 of the cover 800 and the sides 44 of the mounting base 40, and/or of the like. An access opening 816 is also shown extending through the cover 800, which provides access for the operator to engage and disengage the device 700. In this manner, the access opening 816 has a height 818 and length 820 sized to allow the operator to access a lock 780 for the device 700, which is discussed further below. Other components of the device 700 may be concealed behind the cover 800.

Figure 12:
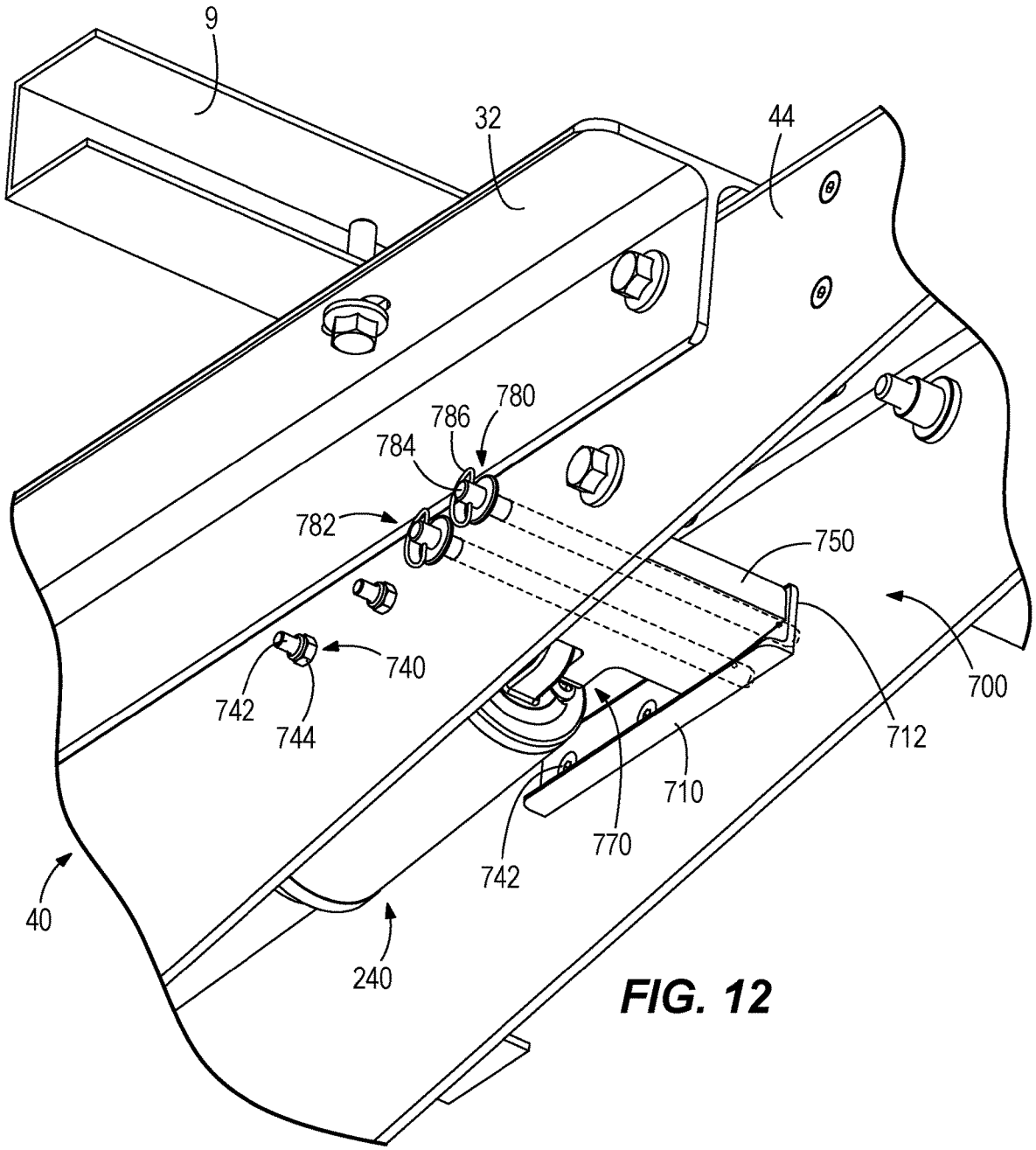
FIG. 12 is close-up isometric front-right view of the device of FIG. 11 shown with a cover removed.
Figure 13:
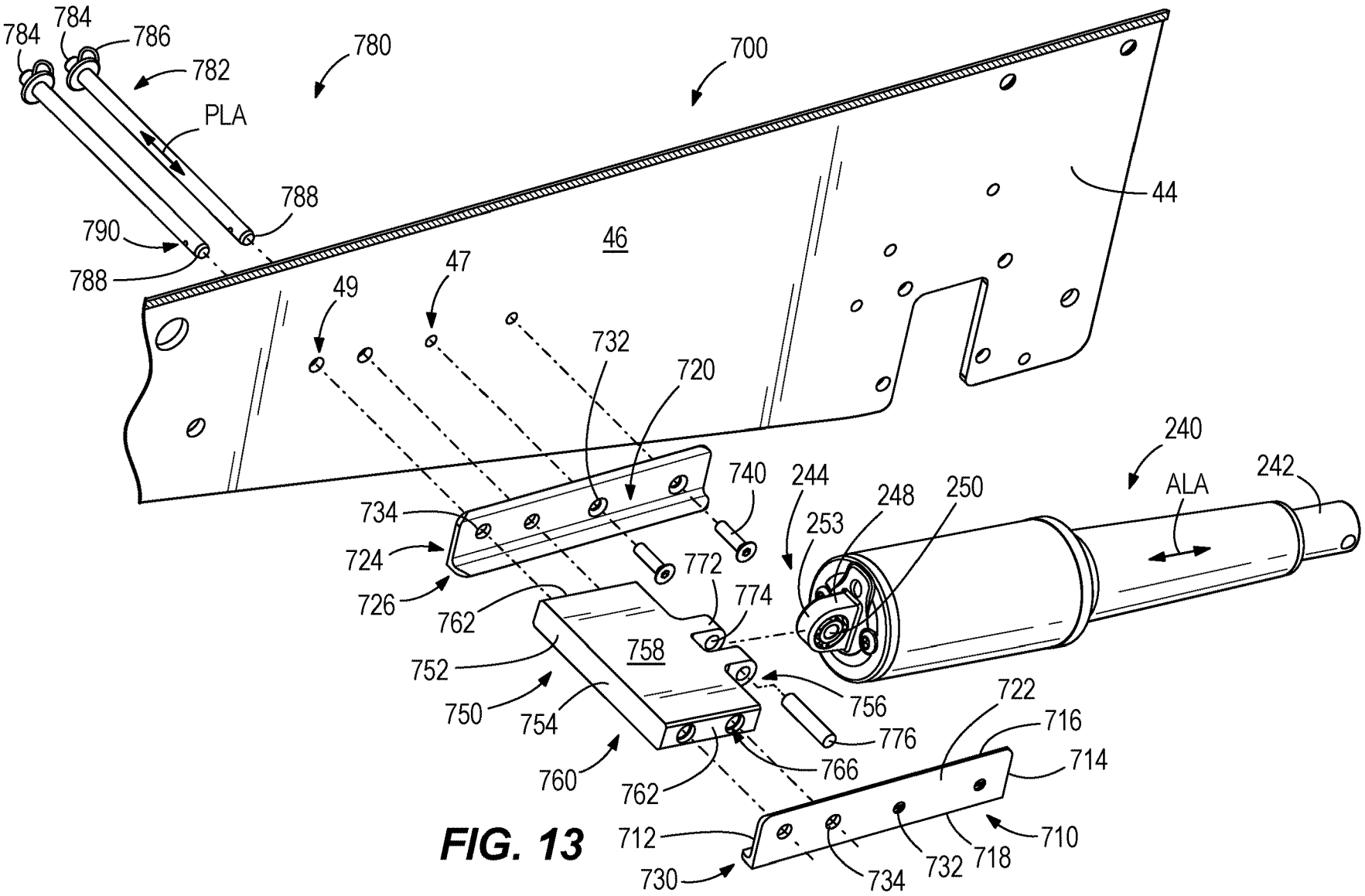
FIG. 13 is an exploded sectional left view of the device of FIG. 11.

FIGS. 12 and 13 depict the device 700 of FIG. 11 without the cover 800 installed. The device 700 includes a pair of rails 710 each extending between a front 712 and a back 714, a top 716 and a bottom 718, and an inside 720 and an outside 722. The rail 710 is an L-bracket 730 formed by a side 724 and a floor 726. A C-channel may alternatively be used as the L-bracket 730 for the rail 710. Openings 732 are defined through the side 724 of the rail 710, as well as rail openings 734. The rails 710 are coupled to opposing sides 44 of the mounting base 40 via fasteners 740 received through the openings 732 in the rail 710 and into the sides 44 of mounting base 40. The fasteners 740 are shown as bolts 742 that engage with nuts 744 on an opposing side of the sides 44 such that the rail 710 is drawn into the sides 44. However, it should be recognized that alternative fasteners 740 are also contemplated by the present disclosure, including bolts 742 received within openings 47 and the sides 44 that are threaded correspondingly. The rail 710 may also or alternatively be coupled to the mounting base 40 using other techniques presently known in the art, including being integrally formed together, welded together, and/or the like.

With continued reference to FIGS. 12 and 13, a carriage 750 is configured to move along the rails 710, particularly between first and second positions as discussed further below. The carriage 750 includes a body 752 and a hinge 770, which as shown here is formed in part by fingers 772 having openings 774 therein. The carriage 750 extends between a front 754 and a back 756, a top 758 and a bottom 760, and sides 762. Carriage openings 766 are formed into in at least one of the sides 762, which may extend partially or entirely through the body 752 transversely. The carriage 750 rests upon the floors 726 of the rails 710 and is constrained via the sides 724 thereof.

It should be recognized that the carriage and rail may also be structurally reversed, for example with the carriage being formed of outwardly facing C-channels that receive elongated bar stock fixed to the opposing sides 44 of the base 40, for example.

With continued reference to FIGS. 12 and 13, the carriage 750 is pivotally coupled to the actuator 240 via the hinge 770. In particular, a mounting bracket 248 is provided at the second end 244 of the actuator 240 and has an opening 250 therein. The mounting bracket 248 has a rounded shape 243 that allows the actuator 240 to pivot relative to the carriage 750 without being constrained by the mounting bracket 248. A fastener 776 extends through the openings 774 in the fingers 772 of the carriage 750, and also through opening 250 in the mounting bracket 248 of the actuator 240. In this manner, the fastener 776 pivotally couples the actuator 240 to the carriage 750, thereby forming the hinge 770. In certain examples, the fastener 776 is a press-fit fastener that may be adhered or welded in position to prevent the fastener 776 from unintentional withdrawal from the hinge 770. It should be recognized that other fasteners 776 are also contemplated by the present disclosure, including nuts and bolts, D-clips, and/or the like.

As discussed above, the carriage 750 is configured to slide on the floors 726 of the rails 710, but may be fixed relative to the rails 710 via engagement of a lock 780. In FIGS. 12 and 13, the lock 780 is a fastener, and specifically a pin 782 having a head 784 and tip 788 defining a pin length axis PLA therebetween. A loop 786 is provided near a head 784, which the operator may use to grasp the pin 782. A detent ball 790 extends perpendicularly away from the pin length PL near the tip 788 of the pin 782. In certain examples, such as shown in FIG. 15, a plunger 785 is provided in the head 784 of the pin 782, which is depressible to allow one or more detent ball 790 to retract into the pin 782 to allow the pin 782 to be inserted and/or retracted from the rail openings 734 in the rail 710 and carriage opening 766 in the carriage 750.

Returning to FIGS. 12 and 13, the pin 782 is insertable through rail openings 734 in the rails 710 and the carriage openings 766 in carriage 750 to thereby prevent the carriage 750 from sliding along the rail 710 (the lock 780 thereby being engaged). To disengage the lock 780 and permit the carriage 750 to again slide along the rails 710, the operator may grasp the loop 786 and withdraw the pin 782 from the carriage openings 766. It should be recognized that the number of locks 780 may vary, as well as the location and configuration of each lock 780 is selectively engaging the carriage 750 and the rails 710 (e.g., clamps, bolt-locks commonly used for securing doors, and/or the like). The rail openings 734 and carriage openings 766 may also be in differing locations, for example in the bottoms 718, 760 of the rails 710 and carriage 750, respectively.

Figure 14:
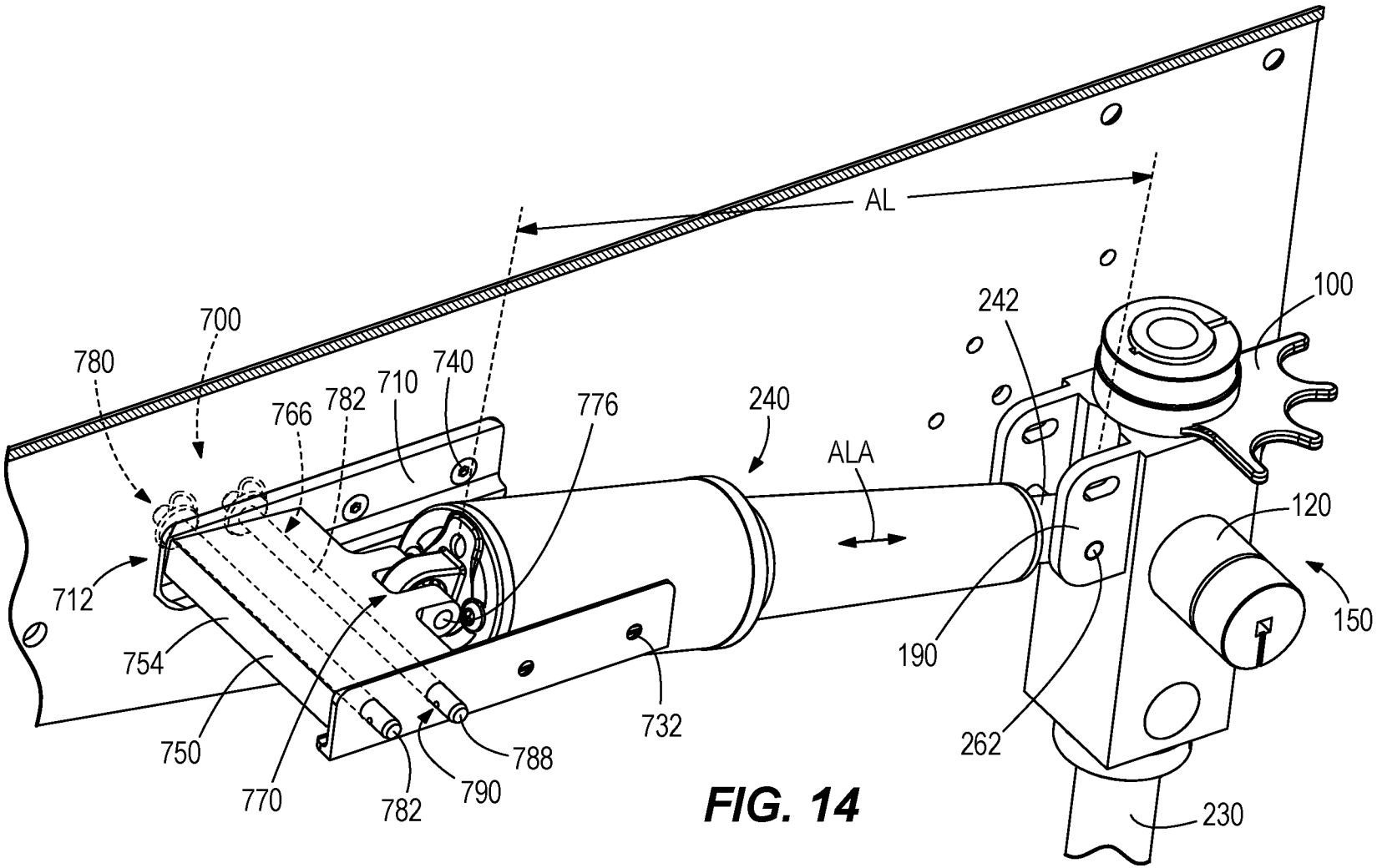
FIG. 14 is a sectional left view of the device of FIG. 13 assembled, with the presently disclosed device engaged and the propulsor in a deployed position.
Figure 15:
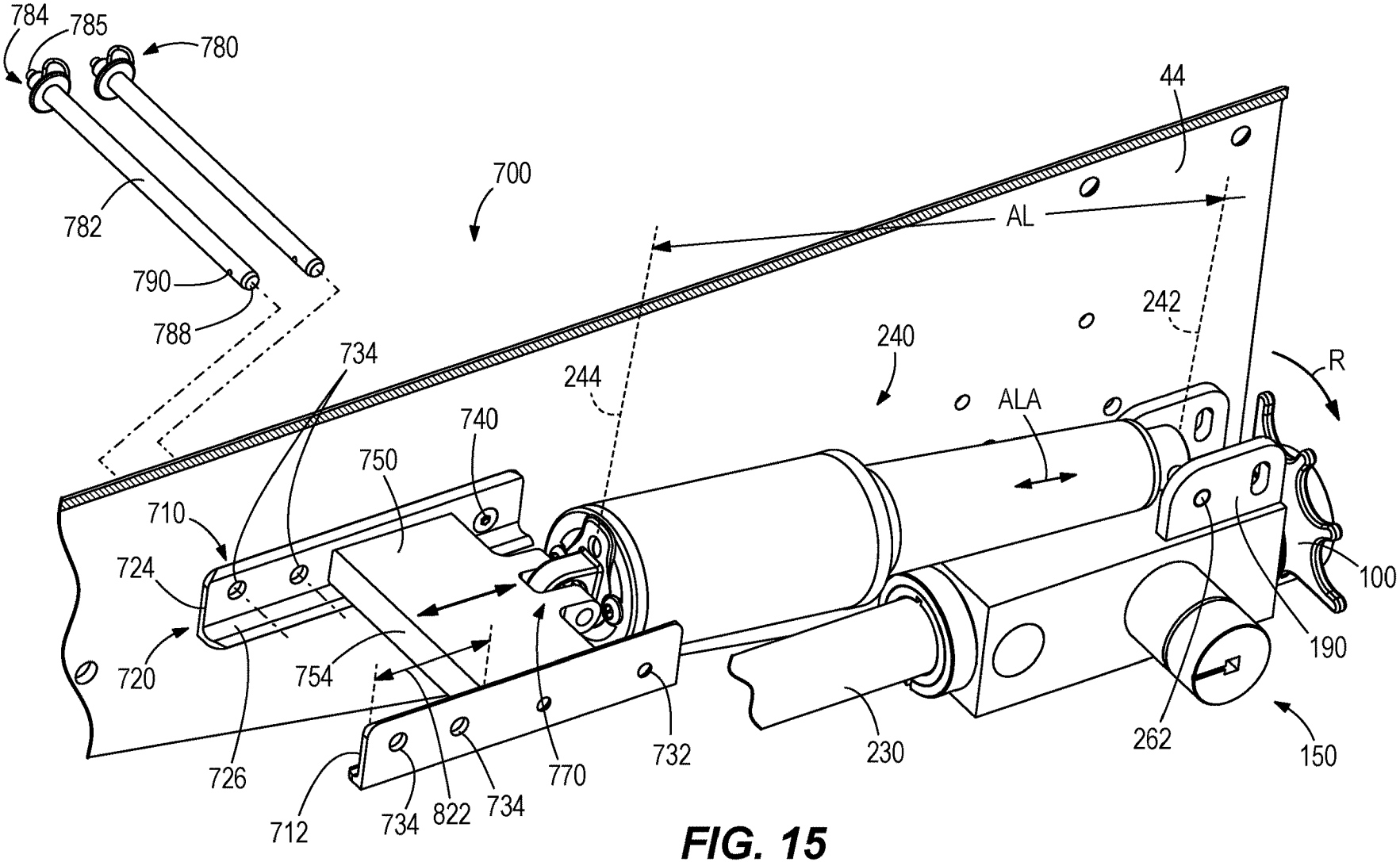
FIG. 15 is a sectional left view of the device of FIG. 13 assembled, with the presently disclosed device disengaged and the propulsor in a stowed position.

FIGS. 14 and 15 show the device 700 in engaged and disengaged positions. FIG. 14 shows the device 700 engaged, whereby the lock 780 is received through the rail 710 and carriage 750 to prevent sliding of the carriage 50 thereon. In this configuration, actuation of the actuator 240 causes rotation of the shaft 230 as the second end 244 of the actuator 240 is constrained by lock 780, thereby only permitting movement of the first end 242 of the actuator 240 along the actuator length axis ALA. The shaft 230 is presently shown in the deployed position, corresponding to the actuator 240 having a given actuator length AL.

However, as discussed above, the present inventors have identified that if the actuator 240 becomes inoperable (for example, in the orientation of FIG. 14), the lock 780 being engaged to fix the carriage 750 in this first position (also referred to as an engaged position) provides that the actuator 240 prevents the shaft 230 from pivoting into the stowed position. In other words, when the lock 780 is engaged, the shaft 230 in the orientation of FIG. 14 can only be pivoted into the stowed position by increasing the actuator length AL of the actuator at 240.

In contrast to propulsion devices 30 known in the art, the presently disclosed device 700 allows the operator to disengage the actuator 240 from the base 40 (here by disengaging the lock 780), thereby allowing the carriage 750 to slide on the rails 710. FIG. 15 shows the locks 780 disengaged by removed or disengaged the pins 782 from the carriage openings 766 in the carriage 750. This disengagement of the locks 780 allows the carriage 750 to slide along the floors 726 of the rails 710. Consequently, the second end 244 of the actuator 240 is no longer fixed to the base 40 of the device 700, and thus the shaft 230 is no longer prevented by the actuator 240 from pivoting about the pivot axis 120 (rotation R). Therefore, while the actuator length AL may not be changeable (e.g., due to inoperability of the actuator 240), the shaft 230 can be manually pivoted into the stowed position by allowing the carriage 750 to slide along the rails 710 (here a distance of 822 to the second position relative to being in the first position as shown in FIG. 14).

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A device for coupling a propulsor to a marine vessel, the device comprising:

a rail configured for attachment to the marine vessel;

a carriage that is moveable relative to the rail into first and second positions;

a shaft having a first end pivotally coupled to the marine vessel and a second end for coupling to the propulsor;

an actuator configured to pivot the shaft relative to the marine vessel to thereby move the propulsor into and between stowed and deployed positions; and a lock that is manually operable to fix the carriage in the first position in which the actuator prevents manual pivoting of the shaft and alternatively in the second position in which the shaft is permitted to be manually pivoted.

2. The device according to claim 1, where the carriage comprises a body that is slidable along the rail.

3. The device according to claim 2, wherein the rail is defined at least in part by two C-channels positioned such that the carriage is slidable therebetween.

4. The device according to claim 1, wherein the actuator is pivotally coupled to carriage.

5. The device according to claim 1, wherein the actuator is an electric linear actuator having first and second ends, and wherein moving the first end away from the second end causes the propulsor to retract towards the marine vessel.

6. The device according to claim 1, wherein the rail, the carriage, and the actuator are contained within a cover when the propulsor is in the stowed position, and wherein the lock is configured to be engaged and disengaged from outside the cover.

7. The device according to claim 1, wherein the rail has sides that extend downwardly from the marine vessel, wherein at least one rail opening is defined within at least one of the sides, and wherein the lock includes a pin that is extendable through the at least one rail opening to engage with the carriage.

8. The device according to claim 7, wherein the carriage is positioned between the sides of the rail, wherein first and second rail openings of the at least one rail opening are defined within first and second sides of the at least one of the sides, respectively, and wherein the pin extends through the first and second rail openings simultaneously.

9. The device according to claim 7, wherein a carriage opening is defined within the carriage, and wherein the pin is receivable in the carriage opening when extending through the at least one rail opening.

10. The device according to claim 9, wherein the carriage opening extends entirely through the carriage.

11. The device according to claim 7, wherein the pin is a ball lock pin that ends through both of the sides of the rail.

12. The device according to claim 7, wherein the pin extends through the at least one rail opening perpendicularly to a length of the actuator between the first and second ends.

13. A method for making a device for coupling a propulsor to a marine vessel, the method comprising:

configuring a rail to be attachable to the marine vessel;

engaging a carriage with the rail, the carriage being moveable into first and second positions;

pivotally coupling a shaft at a first end thereof to the marine vessel, a second end of the shaft being configured for coupling to the propulsor;

configuring an actuator to pivot the shaft relative to the marine vessel to thereby move the propulsor into and between stowed and deployed positions; and configuring a lock to be manually operable to fix the carriage in the first position in which the actuator prevents manual pivoting of the shaft and alternatively in the second position in which the shaft is permitted to be manually pivoted.

14. The method according to claim 13, wherein the rail is defined at least in part by two C-channels positioned such that the carriage is slidable therebetween.

15. The method according to claim 13, wherein the actuator is pivotally coupled to the carriage.

16. The method according to claim 13, further comprising providing a cover that contains the rail, the carriage, and the actuator at least partially therein when the propulsor is in the stowed position, and further comprising defining an opening within the cover such that the lock is engageable and disengageable from outside the cover.

17. The method according to claim 13, wherein the rail has first and second sides that extend downwardly from the marine vessel and sandwich the carriage therebetween, further comprising defining first and second openings within the first and second sides, respectively, wherein the lock is a pin that extends through both the first and second rail openings simultaneously to engage the carriage.

18. The method according to claim 17, wherein the pin is a ball lock pin.

19. The method according to claim 13, wherein the rail has sides that extend downwardly from the marine vessel, and wherein the lock is a pin, further comprising defining at least one rail opening within at least one of the sides, and further comprising defining a carriage opening through the carriage, wherein the pin is extendable through the at least one rail opening and the carriage opening.

20. A device for coupling a propulsor to a marine vessel, the device comprising:

a rail configured for attachment to the marine vessel, the rail comprising opposing c-channels that each define an engaged opening and a disengaged opening therein;

a carriage positioned within the opposing c-channels to slide therein along a longitudinal axis, wherein the opposing c-channels prevent the carriage from moving in transverse and vertical axes that are perpendicular to each other and to the longitudinal axis, and wherein a carriage opening is defined through the carriage parallel to the transverse axis;

a shaft having a first end pivotally coupled to the marine vessel and a second end for coupling to the propulsor;

an actuator configured to pivot the shaft relative to the marine vessel to thereby move the propulsor into and between stowed and deployed positions, the actuator being pivotally coupled to the carriage; and a pin configured to select between the actuator being engaged and disengaged, wherein the actuator is engaged when the pin is received through the engaged openings in the rails and the carriage opening such that the pin prevents the carriage from sliding along the rail, and wherein the actuator system is disengaged when the pin is received through the disengaged openings in the rails and the carriage opening, wherein the shaft is manually pivotable only when the actuator is disengaged.

* * * * *